US010400640B2

(12) United States Patent
Eckinger

(10) Patent No.: US 10,400,640 B2
(45) Date of Patent: Sep. 3, 2019

(54) CAMSHAFT HAVING A DECOMPRESSION DEVICE

(71) Applicant: Bayerische Motoren Werke Aktiengesellschaft, Munich (DE)

(72) Inventor: Roland Eckinger, Landshut (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 84 days.

(21) Appl. No.: 15/634,164

(22) Filed: Jun. 27, 2017

(65) Prior Publication Data

US 2017/0292417 A1 Oct. 12, 2017

Related U.S. Application Data

(63) Continuation of application No. PCT/EP2016/051629, filed on Jan. 27, 2016.

(30) Foreign Application Priority Data

Mar. 13, 2015 (DE) ..... 10 2015 204 550

(51) Int. Cl.
*F01L 13/00* (2006.01)
*F01L 13/08* (2006.01)
(Continued)

(52) U.S. Cl.
CPC ..... *F01L 13/085* (2013.01); *F01L 1/08* (2013.01); *F01L 1/18* (2013.01); *F01L 2810/02* (2013.01); *F01L 2810/04* (2013.01)

(58) Field of Classification Search
CPC ..... F01L 13/08; F01L 1/053; F01L 13/0031; F01L 2810/02; F01L 2810/04;
(Continued)

(56) References Cited

U.S. PATENT DOCUMENTS 6,223,708 B1 5/2001 Kampichler et al.
6,250,271 B1 * 6/2001 Ikuma ..... F01L 13/085 123/182.1
(Continued)

FOREIGN PATENT DOCUMENTS

AT 501 030 A1 5/2006
DE 42 21 394 A1 1/1994
(Continued)

OTHER PUBLICATIONS

International Search Report (PCT/ISA/210) issued in PCT Application No. PCT/EP2016/051629 dated Apr. 13, 2016 with English translation (eight pages).
(Continued)

*Primary Examiner* — Marguerite J McMahon
*Assistant Examiner* — Teuta B Holbrook
(74) *Attorney, Agent, or Firm* — Crowell & Moring LLP

(57) ABSTRACT

A camshaft has a decompression device for an internal combustion engine, wherein a valve lifter is rotatably supported in a base circle of a cam, which can be brought into operative connection with a gas exchange valve via rotation. The valve lifter is operatively connected to a centrifugal fly weight, which is arranged coaxially to the camshaft and which is rotatably supported, in such a way that the valve lifter forms a contour of the base circle in the region of action with the gas exchange valve from a certain rotational speed of the camshaft. The camshaft has a cavity in the region of the centrifugal fly weight, to which cavity lubricant pressure can be applied. A radial first bore from the cavity to the centrifugal fly weight is arranged in the camshaft. A slideable element that can be displaced by the lubricant pressure is arranged in the first bore. By way of the design of the camshaft, an unstable centrifugal fly weight is stabilized and thus acoustics are improved.

11 Claims, 2 Drawing Sheets

(51) Int. Cl.
*F01L 1/08* (2006.01)
*F01L 1/18* (2006.01)

(58) Field of Classification Search
CPC ..... F01L 2820/035; F01L 1/16; F01L 1/047; F01L 1/143; F01L 1/04; F01L 13/085; F01L 1/08; F01L 1/18
USPC ..... 123/182.1, 90.6, 90.61–90.67, 90.44
See application file for complete search history.

(56) References Cited

U.S. PATENT DOCUMENTS

| | | | | |
|---|---|---|---|---|
| 2003/0145820 | A1 | 8/2003 | Yoshida et al. | |
| 2007/0240659 | A1* | 10/2007 | Rozario | F01L 1/146 123/90.59 |
| 2009/0064952 | A1* | 3/2009 | Wutzler | F01L 1/047 123/90.18 |
| 2017/0284241 | A1* | 10/2017 | Kataoka | F01L 1/022 |

FOREIGN PATENT DOCUMENTS

| | | | | | |
|---|---|---|---|---|---|
| DE | 196 36 811 | A1 | | 3/1998 | |
| DE | 603 01 021 | T2 | | 4/2006 | |
| EP | 0 407 699 | A1 | | 1/1991 | |
| EP | 2 177 738 | A1 | | 4/2010 | |
| JP | 2008-82188 | A | | 4/2008 | |
| JP | 2008082188 | A | * | 4/2008 | F01L 13/085 |

OTHER PUBLICATIONS

German-language Written Opinion (PCT/ISA/237) issued in PCT Application No. PCT/EP2016/051629 dated Apr. 13, 2016 (five pages).

German Search Report issued in counterpart German Application No. 10 2015 204 550.1 dated Nov. 13, 2015 with partial English translation (10 pages).

* cited by examiner

CAMSHAFT HAVING A DECOMPRESSION DEVICE

CROSS REFERENCE TO RELATED APPLICATIONS

This application is a continuation of PCT International Application No. PCT/EP2016/051629, filed Jan. 27, 2016, which claims priority under 35 U.S.C. § 119 from German Patent Application No. 10 2015 204 550.1, filed Mar. 13, 2015, the entire disclosures of which are herein expressly incorporated by reference.

BACKGROUND AND SUMMARY OF THE INVENTION

The invention relates to a camshaft having a decompression device for an internal combustion engine.

In the past, the predecessor of the camshaft with a decompression device was the decompression lever. The decompression lever actuates, in particular in the case of single-cylinder two-stroke internal combustion engines, a so-called separate decompression valve in the cylinder head or, in the case of four-stroke internal combustion engines, opens one or more exhaust valves in order to reduce the cylinder interior pressure for easier starting. In this case, it is also described as a valve lifter lever. During the starting of the internal combustion engine, the decompression valve allows a part of the gas to escape from the cylinder. Because of this, the force required for cranking the internal combustion engine during starting is significantly reduced. Such decompression devices are employed mainly in single-cylinder internal combustion engines of older motor vehicles, in particular of motorcycles, mopeds, and occasionally also in smaller automobiles or tractors with single-cylinder diesel-operated internal combustion engines.

Accordingly, an automatic decompression device for internal combustion engines is known from the German publication DE 42 21 394 A1. This is a decompression device with a flyweight revolving with the camshaft of the internal combustion engine. In the position pivoted back in the stationary state and at low camshaft rotational speeds, it has a tappet lifting element protruding in the region of the cam running surface of a valve tappet and shifting the same in the valve opening direction, which through the flyweight which swings outward with rising rotational speeds is guided into a position in which it is set out of engagement with the cam running surface of the tappet.

Furthermore, an automatic decompression device for an internal combustion engine, in particular a single-cylinder diesel engine, with at least one exhaust valve and one inlet valve, which are driven by a camshaft with at least one cam, is known from German publication DE 196 36 811 A1, wherein for reducing the cranking resistance during the starting of the internal combustion engine the exhaust valve is lifted. The automatic decompression device for lifting the exhaust valve below a switching speed for the switching from decompression to compression comprises a fully automatic lifting device engaging in the cam of the exhaust valve, which brings about the exhaust valve being lifted off the valve seat.

A further generic camshaft with a decompression device is known, for example, from the European patent application EP 0 407 699 A1.

Disadvantageous in all these known decompression devices is that the decompression function can generate stochastic clicking, which has an undesirable effect on the noise emission of the internal combustion engine. This clicking is caused by an unstable flyweight of the decompression device.

The object of the present invention is to prevent or at least reduce the acoustically conspicuous clicking of the decompression device.

This and other objects are achieved by a camshaft with a decompression device for an internal combustion engine, wherein in a base circle of a cam, which can be operationally connected with a gas exchange valve through rotation, a valve lifter is rotatably mounted, which is operationally connected with a rotatably mounted flyweight arranged coaxially to the camshaft in such a manner that the valve lifter from a certain rotational speed of the camshaft forms a contour of the base circle in the operational region with the gas exchange valve. The camshaft in the region of the flyweight has a cavity to which lubricant pressure can be applied and in the camshaft a radial first bore from the cavity to the flyweight is arranged, wherein in the first bore a slideable element that is displaceable by the lubricant pressure is arranged.

A slideable element installed in the camshaft is supplied with lubricant from the lubricating circuit. As soon as the internal combustion engine starts, this slideable element is radially shifted to the outside by centrifugal force. At the same time, the slideable element is supported by lubricant pressure and remains in the desired position and pushes the flyweight to the outside. In the process, the flyweight is held stable in the deflection position and, according to the invention, can no longer cause the clicking. Accordingly, the clicking is prevented through the configuration of the decompression function according to the invention and no unpleasant noises of the internal combustion engine are created.

With the configuration wherein lubricant can be applied to the cavity via a second bore from a bearing region of the camshaft it is ensured that adequate lubricant with adequate lubricant pressure is always available in order to push the slideable element in the direction of the flyweight.

The measure wherein the element is displaceable by the lubricant in the direction of the flyweight against a spring force of a spring element serves for the general stabilization of the decompression device.

The configurations wherein the flyweight comprises a stop for the element, and wherein the camshaft is a needle roller are preferred embodiments.

The configuration wherein the camshaft is an exhaust camshaft is a particularly preferred embodiment.

Preferentially, the camshaft according to the invention is installed in an internal combustion engine.

Other objects, advantages and novel features of the present invention will become apparent from the following detailed description of one or more preferred embodiments when considered in conjunction with the accompanying drawings.

BRIEF DESCRIPTION OF THE DRAWINGS

In the following, the same reference numbers apply to identical components in the FIGS. 1 to 3.

DETAILED DESCRIPTION OF THE DRAWINGS

Figure 1:
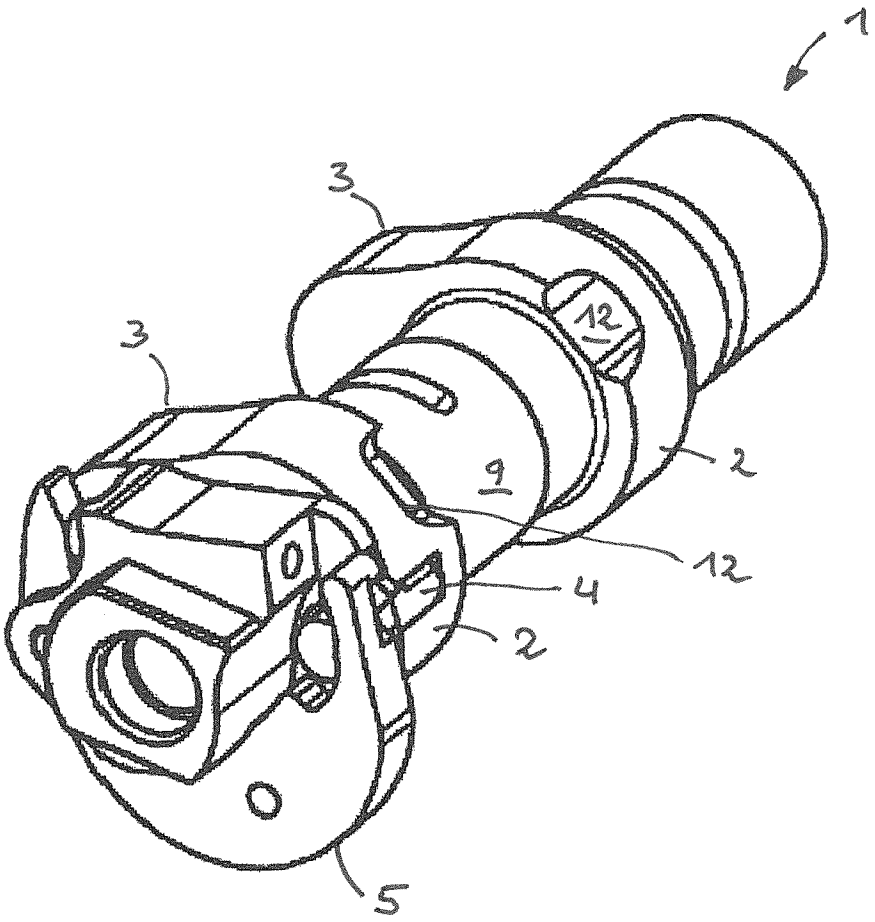
FIG. 1 is a top view of a three-dimensionally represented camshaft according to an embodiment of the invention.

FIG. 1 shows a top view of an exemplary three-dimensionally represented camshaft 1 according to the invention with a decompression device for an internal combustion engine. The camshaft includes two cams 3 each with a base circle 2. For as long as the base circle 2 is operationally connected with a gas exchange valve (which is not shown), the gas exchange valve is closed. Each cam 3 is directly or indirectly operationally connected to a gas exchange valve via a valve cup, a drag lever or rocker arm which is not shown, wherein through rotation of the camshaft 1 and thus also of the cams 3 the gas exchange valves can be actuated.

In a base circle 2 of a cam 3, a valve lifter 4 is rotatably mounted, which is operationally connected with a rotatably mounted flyweight 5 that is arranged coaxially with the camshaft 1 such that the valve lifter 4 from a certain rotational speed of the camshaft 1, is turned by the flyweight 5 in such a manner that the valve lifter 4 constitutes a contour of the base circle 2. This means that from a certain rotational speed of the camshaft 1 the valve lifter 4 is quasi ineffective, and the gas exchange valve remains closed as usual.

Figure 3:
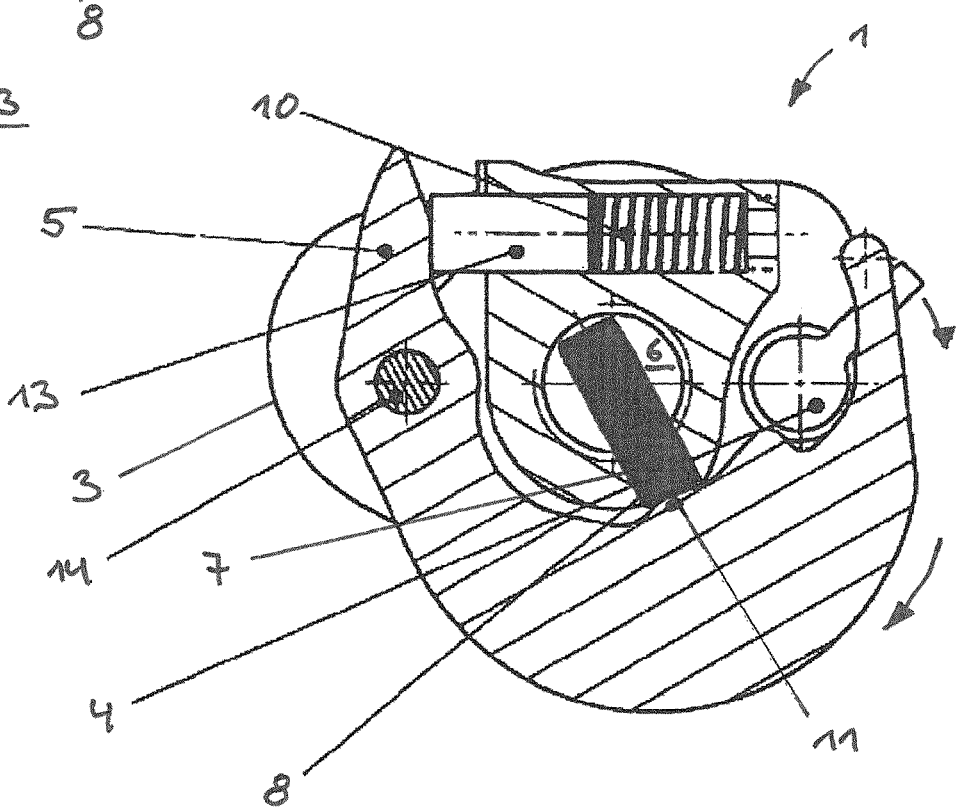
FIG. 3 is a section view A-A from FIG. 2.

During the starting of the internal combustion engine, or at a rotational speed that is less than the defined rotational speed, the flyweight, as is evident in FIG. 3, is pushed by a spring element 10 into a position so that the valve lifter 4 protrudes over the base circle 2 of the cam 3 with a slightly raised contour (0.1 to 1.0 mm). Accordingly, from the starting of the internal combustion engine, up to the defined rotational speed, the gas exchange valve is slightly opened during the normally closed phase. This results in a decompression in the cylinder of the internal combustion engine. Because of this, significantly easier firing of the internal combustion engine is possible.

The camshaft 1 with the decompression device according to the invention is characterized in that the camshaft 1 in the region of the flyweight 5 has a cavity 6 (FIGS. 2 and 3) to which lubricant pressure can be applied and in the camshaft 1 a radial first bore 7 from the cavity 6 in the region of the flyweight 5 is arranged, wherein in the first bore 7 a slideable element 8 that is displaceable by the lubricant pressure is arranged.

In the present exemplary embodiment, the cams 3 each have a recess 12 for weight saving.

Figure 2:
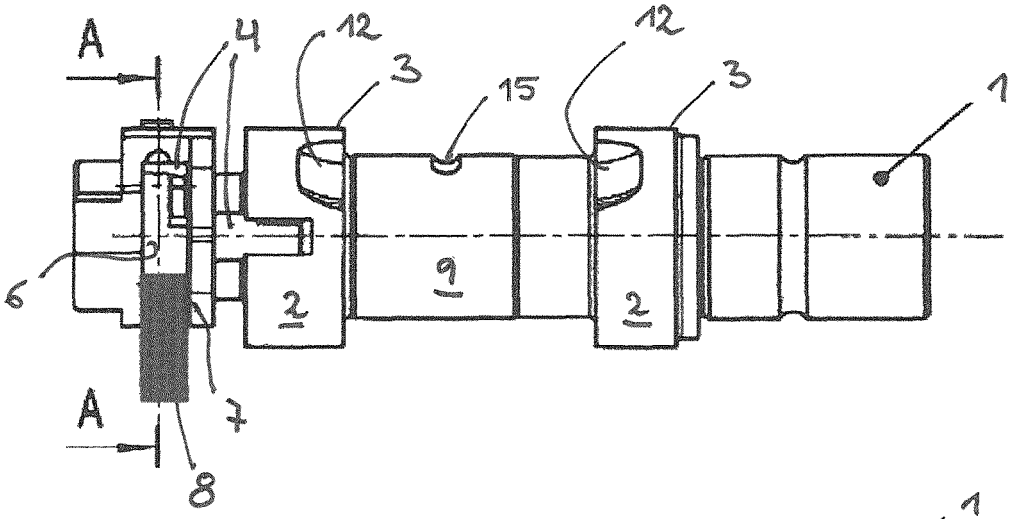
FIG. 2 is a lateral view of the camshaft according to an embodiment of the invention.

FIG. 2 is a lateral view of the camshaft 1 with the decompression device according to the invention. In FIG. 2, the camshaft 1 is represented with a view of the base circle side of the cam 3. Again noticeable are the recesses 12 of the cams 3. Between the cams 3, a bearing region 9 is arranged, in which a third bore 15 is arranged, which is connected to the cavity 6. During the operation of the internal combustion engine the camshaft 1 is rotated and lubricant is applied to the cavity 6 via the third bore 15, as a result of which an overpressure forms in the cavity 6 which pushes the slideable element 8 in the first bore 7 radially to the outside. The cavity 6 can be realized, for example, by an axial bore through the camshaft 1, which is closed off on both sides at the ends of the camshaft 1. This can be realized, for example, by a closure plug or by a screw that is permanently screwed into the bore at the camshaft end. The closure of the cavity 6 thus makes possible building up the lubricant pressure in the cavity 6 in order to hold the slideable element 8 in the desired radially outer deflection position.

Through the slideably arranged element 8, a section A-A in FIG. 2 is taken perpendicularly to the drawing plane, which is shown in FIG. 3.

FIG. 3 shows the section A-A from FIG. 2 through the slideable element 8 and the decompression device. Centrally, the cavity 6, into which the slideable element 8 in the first bore 7 projects, is noticeable in FIG. 3. The flyweight 5 is rotatably mounted on an axis of rotation 14. A direction of rotation of the flyweight 5 upon rotation of the camshaft 1 from a defined rotational speed is schematically shown by an arrow, likewise a rotation of the valve lifter 4 connected with this. At the same time, the slideable element 8 lies against a stop 11 of the flyweight 5.

In the stationary state of the camshaft 1, the spring element 10, via a pressure element 13, pushes the flyweight 5 about the axis of rotation 14 with the stop 11 onto the slideable element 8. On the side facing away from the spring element 10, the flyweight 5 is operationally connected to the valve lifter 4. In the position shown in FIG. 3, i.e. with the internal combustion engine stationary, the valve lifter 4 is formed in the region of the base circle 2 of the cam 3 in such a manner that it protrudes approximately 0.1 to 1.0 mm over the base circle 2 for a decompression of the cylinder.

When the internal combustion engine is now started, a lubricant pressure builds up in the cavity 6 while the flyweight 5 at the same time turns radially to the outside with a support of the lubricant pressure which pushes the slideable element 8 likewise radially to the outside. In the process, the flyweight 5 turns according to the arrow in clockwise direction and turns the valve lifter 4 in such a manner that it assumes the same contour in the base circle 2 as the base circle 2 itself. A decompression is thus securely avoided from a defined rotational speed.

As shown in FIG. 3, the element 8 is preferably displaceable by the lubricant in the direction of the flyweight 5 against the spring force of the spring element 10. Furthermore, the flyweight 5 preferably comprises a stop 11 for the slideable element 8. In a further preferred embodiment, the element 8 is a needle roller. Particularly preferably, the camshaft 1 with a decompression device is used as an exhaust camshaft of a valve train of an internal combustion engine.

In other words, the slideable element 8 installed in the camshaft 1 is supplied with lubricant from the lubricant circuit. As soon as the internal combustion engine fires, the slideable element 8, preferably a needle roller, is radially displaced to the outside by the lubricant pressure that builds up in the cavity 6. As soon as the internal combustion engine fires, the slideable element 8 is displaced to the outside by centrifugal force. At the same time, the slideable element 8 is supported by lubricant pressure in the cavity 6 and remains in the desired radially outer position. In the process, the flyweight 5 is held stable in the deflection position and can no longer cause the acoustic abnormality. In the manner of the invention, this means no clicking of the decompression device and thus no unpleasant noises of the internal combustion engine.

LIST OF REFERENCE NUMBERS

1 Camshaft
2 Base circle
3 Cam
4 Valve lifter
5 Flyweight
6 Cavity
7 First bore
8 Element
9 Bearing region
10 Spring element
11 Stop
12 Recess
13 Pressure body
14 Axis of rotation
15 Second bore The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A camshaft having a decompression device for an internal combustion engine, comprising:

a cam of the camshaft, the cam having a base circle;

a valve lifter rotatably mounted in the base circle of the cam;

a rotatably mounted flyweight arranged coaxially with the camshaft, the valve lifter being operationally connected with the rotatably mounted flyweight such that the valve lifter, from a certain rotational speed of the camshaft, is turned by the flyweight in such a manner that the valve lifter forms a contour of the base circle, wherein the camshaft in a region of the flyweight comprises a cavity to which a lubricant pressure is applied, a first radial bore is arranged in the camshaft from the cavity to the flyweight, and in the first radial bore, a slideable element is arranged, the slideable element being displaceable via the lubricant pressure.

2. The camshaft according to claim 1, wherein a lubricant is applied to the cavity via a second bore from a bearing region of the camshaft.

3. The camshaft according to claim 2, wherein the slideable element is displaceable by the lubricant in a direction of the flyweight against a spring force of a spring element.

4. The camshaft according to claim 3, wherein the flyweight comprises a stop for the slideable element.

5. The camshaft according to claim 4, wherein the slideable element is a needle roller.

6. The camshaft according to claim 5, wherein the camshaft is an exhaust camshaft.

7. The camshaft according to claim 1, wherein the slideable element is displaceable by a lubricant in a direction of the flyweight against a spring force of a spring element.

8. The camshaft according to claim 1, wherein the flyweight comprises a stop for the slideable element.

9. The camshaft according to claim 1, wherein the slideable element is a needle roller.

10. The camshaft according to claim 1, wherein the camshaft is an exhaust camshaft.

11. An internal combustion engine, comprising a camshaft according to claim 1.

* * * * *